US005910621A

United States Patent [19]

Harris et al.

[11] Patent Number: 5,910,621

[45] **Date of Patent: *Jun. 8, 1999**

[54] TREATMENT OF TITANIFEROUS MATERIALS

[75] Inventors: Harold Robert Harris, Leeman; Halil Aral, Elwood; Warren John Bruckard, North Balwyn; David Edward Freeman, North Dandenong; Martin Richard Houchin, Pascoe Vale; Kenneth Joun McDonald, Glen Waverley; Graham Jeffrey Sparrow, Vermont South; Ian Edward Grey, Black Rock, all of Australia

[73] Assignee: RGC Mineral Sands, Australia

[ * ] Notice: This patent is subject to a terminal disclaimer.

[21] Appl. No.: 08/938,029

[22] Filed: Sep. 19, 1997

Related U.S. Application Data

[62] Continuation of application No. 08/733,786, Oct. 18, 1996, abandoned, which is a division of application No. 08/379,554, filed as application No. PCT/AU93/00381, Jul. 28, 1993, Pat. No. 5,578,109.

[30] Foreign Application Priority Data

Jul. 31, 1992 [AU] Australia ..... 3876/92
Dec. 16, 1992 [AU] Australia ..... 6401/92

[51] Int. Cl.[6] ..... C22B 60/02

[52] U.S. Cl. ..... 75/399; 75/395; 75/414; 75/612; 423/20; 423/111; 423/155; 588/19

[58] Field of Search ..... 75/393, 395, 399, 75/414, 612; 588/19; 423/3, 20, 111, 155

[56] References Cited

U.S. PATENT DOCUMENTS

| | | | |
|---|---|---|---|
| 2,721,793 | 10/1955 | Magri et al. . | |
| 2,815,272 | 12/1957 | Armant et al. . | |
| 2,974,014 | 3/1961 | Hockje et al. . | |
| 3,502,460 | 3/1970 | Martin et al. . | |
| 3,681,047 | 8/1972 | Lynd et al. . | |
| 3,764,651 | 10/1973 | Henkel et al. . | |
| 3,816,099 | 6/1974 | Stewart et al. . | |
| 3,856,512 | 12/1974 | Dalmer et al. . | |
| 3,922,164 | 11/1975 | Reid et al. . | |
| 4,097,574 | 6/1978 | Auger et al. . | |
| 4,384,883 | 5/1983 | Fensom . | |
| 4,762,552 | 8/1988 | Baldwin et al. . | |
| 5,011,666 | 4/1991 | Chao et al. . | |
| 5,051,165 | 9/1991 | Andrews | 209/166 |
| 5,085,837 | 2/1992 | Chao et al. . | |
| 5,181,956 | 1/1993 | Chao . | |
| 5,411,719 | 5/1995 | Hollitt et al. . | |
| 5,427,749 | 6/1995 | Hollitt et al. . | |
| 5,578,109 | 11/1996 | Harris et al. | 75/399 |

FOREIGN PATENT DOCUMENTS

| | | |
|---|---|---|
| 516155 | 3/1979 | Australia . |
| 881808 | 11/1961 | United Kingdom . |
| 1225826 | 3/1971 | United Kingdom . |
| WO91/13180 | 9/1991 | WIPO . |

*Primary Examiner*—Ngoclan Mai
*Attorney, Agent, or Firm*—Harness, Dickey & Pierce, P.L.C.

[57] ABSTRACT

A process for facilitating the removal of impurities e.g. radionuclides, such as uranium and thorium, and/or one or more of their radionuclide daughters, from titaniferous material includes contacting the titaniferous material with one or more reagents at an elevated temperature selected to enhance the accessibility of at least one of the radionuclide daughters in the titaniferous material. The reagent(s) may be a glass forming reagent and is selected to form a phase at the elevated temperature which disperses onto the surfaces of the titaniferous material and incorporates the radionuclides and one or more radionuclide daughter. The titaniferous material may be, e.g., ilmenite, reduced ilmenite, altered ilmenite or synthetic rutile.

34 Claims, No Drawings

TREATMENT OF TITANIFEROUS MATERIALS

This is a continuation of U.S. Pat. application Ser. No. 08/733,786, filed Oct. 18, 1996 now abandoned, which is a continuation of U.S. Pat. application Ser. No. 08/379,554, filed Apr. 6, 1995, now U.S. Pat. No. 5,578,109 issued Nov. 26, 1996, which is a 371 of PCT/AU93/00381 on Jul. 28, 1993.

This invention relates to a process for facilitating the removal of impurities, especially but not only radionuclides such as uranium and thorium and their radionuclide daughters, from titaniferous materials, and is concerned in particular embodiments with the removal of uranium and thorium from weathered or "altered" ilmenite and products formed from the ilmenite.

Ilmenite ($FeTiO_3$) and rutile ($TiO_2$) are the major commercially-important, mineral feedstocks for titanium metal and titanium dioxide production. Although, ilmenite and rutile almost invariably occur together in nature as components of "mineral sands" or "heavy minerals" (along with zircon ($ZrSiO_4$) and monazite ((Ce, La, Th)$PO_4$)), ilmenite is usually the most abundant. Natural weathering of ilmenite results in partial oxidation of the iron, originally present in ilmenite in the ferrous state ($Fe^{2+}$), to ferric iron ($Fe^{3+}$). To maintain electrical neutrality, some of the oxidised iron must be removed from the ilmenite lattice. This results in a more, porous structure with a higher titanium (lower iron) content. Such weathered materials are known as "altered" ilmenites and may have $TiO_2$ contents in excess of 60%, compared with 52.7% $TiO_2$ in stoichiometric (unaltered) ilmenite. As, weathering, or alteration, of the ilmenite proceeds, impurities such as alumino-silicates (clays) are often incorporated into the porous structure as discrete, small grains that reside in the pores of the altered ilmenite. It appears that uranium and thorium can also be incorporated into the ilmenite pores during this process.

Most of the world's mined ilmenite is used for the production of titanium dioxide pigments for use in the paint and paper industries. Pigment grade $TiO_2$ has been traditionally produced by reacting ilmenite with concentrated sulphuric acid and subsequent processing to produce a $TiO_2$ pigment—the so-called sulphate route. However this process is becoming increasingly undesirable on environmental grounds due to the large volumes of acidic liquid wastes which it produces. The alternative process—the so-called chloride route—involves reaction with chlorine to produce volatile titanium tetrachloride and subsequent oxidation to $TiO_2$. Unlike the sulphate route, the chloride route is capable of handling feedstocks, such as rutile, which are high in $TiO_2$ content and low in iron and other impurities.

Consequently the chloride-route presents fewer environmental problems and has become the preferred method for $TiO_2$ pigment production. Also whilst the sulphate route is capable of producing only $TiO_2$ pigments, both titanium metal and $TiO_2$ pigments can be produced via the chloride route. Natural rutile supplies are insufficient to meet the world demands of the chloride-route process. Thus there is an increasing need to convert the more—plentiful ilmenites and altered ilmenites (typically 45 to 65% $TiO_2$) to synthetic rutile (containing over 90% $TiO_2$). A number of different processes have been developed to upgrade ilmenite to synthetic rutile (SR), the most widely used, commercially, being the Becher process.

The Becher process involves reducing the iron in ilmenite (preferably altered ilmenite) to metallic iron in a reduction kiln at high temperatures to give so called reduced ilmenite, then oxidising the metallic iron in an aerator to produce a fine iron oxide that can be physically separated from the coarse titanium-rich grains forming a synthetic rutile. The product normally undergoes a dilute acid leach. Sulphur may be added to the kiln to facilitate removal of manganese and residual iron impurities, by formation of sulphides which are removed in the acid leach. The titanium-rich synthetic rutile so produced contains typically >90% $TiO_2$.

Whether ilmenite is marketed as the raw mineral or as upgraded, value-added, synthetic rutile, producers are being increasingly required to meet more stringent guide-lines for the levels of the radioactive elements uranium and thorium in their products. The Becher synthetic rutile process does not significantly reduce the levels of uranium and thorium in the product and so there exists an increasing need to develop a process for removal of uranium and thorium from ilmenite and other titaniferous materials (e.g. synthetic rutile).

Frequently ilmenite concentrates contain low levels of thorium due to monazite contamination. It is not the purpose of this invention to remove macroscopic monazite grains from titaniferous materials, but rather to remove microscopic uranium and thorium originally incorporated into the ilmenite grains during the weathering process.

It has previously been disclosed in Australian patent applications 14980/92 and 14981/92 that uranium and thorium can be removed from titaniferous material by treatment with acid containing soluble fluoride or with base followed by an acid treatment, respectively. However, while these treatments were found to indeed remove uranium and thorium from titaniferous material, it has now been discovered that the radioactivity of the material is not reduced to the extent expected from the reduction in thorium and uranium content. Further investigation has shown that this is occurring because the prior treatments are primarily removing the parent uranium and thorium isotopes, and the radionuclide daughters are not being removed to the same extent. This finding is surprising because the observed differential behavior is the opposite of what has generally been observed with leaching treatments of radioactive materials in other fields, where the radionuclide daughters are generally removed as well as or more readily than the parent.

More specifically, for the $^{232}Th$ chain, we have found that none of the daughters are removed to the same extent as the parent $^{232}Th$. This observation indicates that after, or as a result of, the transformation of $^{232}Th$ to its immediate daughter $^{228}Ra$, a process takes place whereby $^{228}Ra$ and all of its daughters, including $^{228}Th$, are made less accessible than the parent $^{232}Th$ to removal by the processes described in the above patent applications. This conclusion is confirmed by the observation that, after applying the above processes to altered ilmenite, the $^{228}Th$ isotope is often found to be in equilibrium with $^{228}Ra$, but not with $^{232}Th$. If the $^{228}Th$ and $^{232}Th$ isotopes were in the same physical environment, they would behave identically during chemical processing.

It has been surprisingly found, in accordance with a preferred first aspect of the invention, that a heating treatment may be applied to the titaniferous material effective to enhance the accessibility of the radionuclides and/or at least one of the radionuclide daughters to subsequent removal processes, whether those described in Australian patent applications 14980/92 and 14981/92 or otherwise. Preferably, the parent isotope, eg $^{232}$Th in the thorium decay chain, and its radionuclide daughters, eg $^{228}$Ra and $^{228}$Th, are rendered substantially equally accessible to subsequent thorium and/or uranium removal processes.

According to the first aspect of the present invention there is therefore provided a process for facilitating the removal of radionuclides from titaniferous material which comprises the step of heating the titaniferous material to an extent effective to enhance the accessibility of at least one of the radionuclide daughters to subsequent removal. The radionuclides maybe thorium and/or uranium and/or one or more of their radionuclide daughters.

The heating temperature is preferably in excess of 500° C. Indeed it is found that in a first temperature range, eg between 500° C. and 1000° C., there is an enhanced removal of radionuclide daughters (eg $^{228}$Th) but diminished parent (eg $^{232}$Th) removal. In a second temperature range, eg 1000° C. to 1300° C., and especially at or above 1200° C., removal of the parent and daughter radionuclides improves and occurs to a similar extent, while for still higher temperatures, eg 1400° C., the total removal is high and the similar removal of the parent and daughter radionuclides is sustained, thereby achieving a good reduction in radioactivity.

The heating step may be optimised for either chemical or physical removal processes and can be performed in either an oxidising or reducing atmosphere, or a combination of both, in any appropriate oven, furnace or reactor. It will be appreciated that the optimal heating conditions will depend upon the process of the subsequent removal step.

The processes described in Australian patent applications 14980/92 and 14981/92 were found to be more effective at removing uranium and/or thorium from ilmenite than from synthetic rutile produced by the Becher process. We have now also found that a heating treatment of the ilmenite prior to Becher processing, in accordance with the first aspect of the invention, renders the uranium and thorium in the synthetic rutile product more susceptible to subsequent leaching.

We have further found that a heat treatment of synthetic rutile, after Becher processing, also renders the uranium and thorium more susceptible to subsequent leaching.

Prior to heat treatment the thorium was found to be distributed extremely finely in altered ilmenite grains (below the level of resolution of Scanning Electron Microscopy). After heat treatment of the titaniferous material in accordance with the first aspect of the invention, to a temperature of about 1200° C. or higher, thorium rich phases of up to several microns in size could be identified at and below the surface of the titaniferous grains. The aggregation and concentration of the thorium into discrete phases, which has been observed for both ilmenite and synthetic rutile, may allow physical (as well as chemical) separation of the thorium-rich phase from the titanium-rich phases by an appropriate subsequent process, eg attritioning. The temperatures required for optimal segregation of the thorium-rich phase are, however, higher than those necessary to render $^{232}$Th and its daughters equally accessible to chemical separation processes, eg leaching.

In accordance with a second aspect of the invention, titaniferous material may be subject to a pretreatment effective to cause aggregation or concentration of the radionuclides and/or one or more of the radionuclide daughters into identifiable deposits or phases, whereby to enhance subsequent separation of the radionuclides and daughters from the material.

According to the second aspect, the invention provides a process for facilitating the removal of radionuclides and/or one or more of their radionuclide daughters from titaniferous material which comprises the step of treating the titaniferous material to cause aggregation or concentration of the radionuclides and one or more of their radionuclide daughters, to an extent effective to enhance the accessibility of at least one of the radionuclide daughters to subsequent removal. The radionuclides may be thorium and/or uranium and/or one or more of their radionuclide daughters.

This treatment preferably includes a heat treatment. Such heat treatment may be performed in an oxidising atmosphere, or in a reducing atmosphere or in an oxidising atmosphere and then a reducing atmosphere or in a reducing atmosphere and then an oxidising atmosphere. The treatment preferably further includes the contacting of the titaniferous material with one or more reagents selected to form a phase as a result of said heat treatment, which phase disperses onto the surfaces of the titaniferous material and incorporates the radionuclides and said one or more radionuclide daughters.

The reagent(s) are believed to be effective in providing in said phase a medium for enhanced aggregation or concentration of the thorium and/or uranium, whereby to facilitate separation of the thorium and/or uranium and/or their radionuclides daughters during subsequent leaching. They also tend to lower the heating temperature required to achieve a given degree of radionuclide removal.

In a third aspect of the invention, there is provided a process for facilitating the removal of radionuclides, such as eg uranium and thorium, and/or one or more of their radionuclide daughters from titaniferous material which comprises contacting the titaniferous material with one or more reagents at an elevated temperature selected to enhance the accessibility of at least one of the radionuclide daughters in the titaniferous material, the reagent(s) being selected to form a phase at said elevated temperature which disperses onto the surfaces of the titaniferous material and incorporates the radionuclides and said one or more radionuclide daughters.

Usefully, the aforementioned phase incorporating the radionuclides may take up other impurities such as silicon/silica, aluminium/alumina, manganese, and residual iron which can be removed along with the radionuclides on dissolution of the phase.

In a fourth aspect, the invention provides a process for facilitating the removal of one or more impurities from titaniferous material which comprises contacting the titaniferous material with one or more reagents at an elevated temperature, the reagent(s) being selected to form a phase at said elevated temperature which disperses onto the surfaces of the titaniferous material and incorporates the impurity(s). The impurities may comprise one or more of the group including silicon and/or silica, aluminium and/or alumina, manganese and residual iron.

In the second, third and fourth aspects of the invention, the reagent, or reagents, preferably comprise glass forming reagents such as borates, fluorides, phosphates, and silicates. By glass forming reagent is meant a compound which at an elevated temperature transforms to a glassy i.e. non-crystalline phase, comprising a three-dimensional network of atoms, usually including oxygen. The glass forming reagents may be added individually or in a combination or mixture of two or more of the compounds. In addition, reagents that act as glass modifiers i.e. as modifiers of the aforementioned network phase, such as alkali and alkaline earth compounds, may also be added with the glass forming reagents. The glass modifiers may be added as, for example, an oxide, carbonate, hydroxide, fluoride, nitrate or sulphate compound. The glass forming reagents and glass modifiers added may be naturally occurring minerals, for example borax, ulexite, colemanite or fluorite, or chemically synthesised compounds.

Particularly effective glass forming reagents for the second and third aspects of the invention, in the sense that they achieve optimum incorporation of the radionuclides and radionuclide daughters in the glassy phase, include alkali and alkaline earth borates, more preferably sodium and calcium borates and calcium sodium borates. Examples of such borates include $Ca_2B_6O_{11}$, $NaCaB_5O_9$ and $Na_2B_4O_7$, which are respectively represented by the minerals colemanite $Ca_2B_6O_{11}0.5H_2O$, ulexite $NaCaB_5O_90.8H_2O$ and borax $Na_2B_4O_70.10H_2O$. Especially advantageous are calcium borates. An effective glass modifier in conjunction with these borates is fluorite (calcium fluoride).

A suitable elevated temperature effective to achieve a satisfactory or better level of radionuclide incorporation is in the range 900 to 1200° C., optimally 1050 to 1200° C.

In each of the four aspects of the invention, the titaniferous material may be ilmenite, altered ilmenite, reduced ilmenite or synthetic rutile.

The radionuclide daughter(s) whose accessibility is enhanced preferably include $^{228}Th$ and $^{228}Ra$.

The invention preferably further includes the step of separating radionuclide(s) from the titaniferous material.

The process, in any of its aspects, may further include treatment of the titaniferous material in accordance with one or both of Australian patent applications 14980/92 and 14981/92, ie leaching the material with an acid containing fluoride or treatment with a basic solution followed by an acid leach, or treatment with an acid or acids only. For example, the acid leach may be effective to dissolve the phase incorporating the radionuclides and radionuclide daughters, and to thereby extract the latter from the titaniferous material. The aforesaid reagent(s) may therefore be selected, inter alia, with regard to their solubility in acid, and borates are advantageous in this respect. An effective acid for this purpose is hydrochloric acid, e.g. of about IM but sulphuric acid may be preferable on practical grounds. If sulphuric acid is employed for the primary leach, a second leach with e.g. hydrochloric acid may still be necessary, preferably after washing, to extract the radionuclide daughter radium ($^{228}Ra$). When used as a second leach for this purpose rather than as the primary leach, the radium may be removed and the hydrochloric acid recirculated. The acid leach may be carried out with added fluoride, which may be advantageously provided by a fluoride reagent in the original mixture of reagents. Effective fluoride reagents for this purpose include NaF and $CaF_2$.

The leached solids residue may then be washed by any conventional means, such as filtration or decantation, to remove the radionuclide-rich liquid phase. This may be followed by drying or calcination.

An especially preferred application, embodying the aforedescribed aspects of the invention, may be to the production of synthetic rutile (SR) from ilmenite by an iron reduction process such as the Becher process. As mentioned, in this process, iron oxides in ilmenite are reduced largely to metallic iron in a reducing atmosphere in a kiln, at a temperature in the range 900–1200° C., to obtain so-called reduced ilmenite. The aforementioned reagent(s) are also delivered to the kiln, and form(s) the phase which disperses onto the surfaces of the titaniferous material and incorporates the radionuclides and one or more of the radionuclide daughters. The cooled reduced ilmenite, or the synthetic rutile remaining after subsequent aqueous oxidation of the iron and separation out of the iron oxide, is subjected to an acid leach as discussed above to remove the thorium. A proportion of the radionuclides may also be removed at the aqueous oxidation stage.

The invention accordingly provides, in a particular aspect, a process for treating iron-containing titaniferous material, eg an ore such as ilmenite, by reducing iron in the titaniferous material largely to metallic iron in a reducing atmosphere in a kiln, preferably an elongated rotary kiln, thereby producing a so-called reduced titaniferous material, comprising feeding the titaniferous material, a reductant, preferably a particulate carbonaceous material eg coal and one or more reagents, as discussed above and preferably including one or more glass forming compounds, to the kiln, maintaining an elevated temperature in the kiln, recovering a mixture which includes the reduced titaniferous material from the kiln at a discharge port, and treating the reduced titaniferous material to remove thorium and/or uranium and/or one or more of their radionuclide daughters. The maintained elevated temperature is preferably in the range 900 to 1200° C., most preferably 1050 to 1200° C.

This process preferably incorporates one or more of the main steps of the Becher process as follows:

1. Reduction, in the rotary kiln, of the iron oxides contained in the ilmenite feed largely to metallic iron using coal as the heat source and the reductant.

2. Cooling of the mixture discharging from the reduction kiln.

3. Dry physical separation of the reduced ilmenite and surplus char.

4. Aqueous oxidation (known as aeration) of the reduced ilmenite to convert the metallic iron to iron oxide particles discrete from the $TiO_2$-rich mineral particles.

5. Wet physical separation to remove the iron aside from the $TiO_2$-rich mineral partides.

6. An optional acid leaching stage to remove a portion of the residual iron and manganese.

7. Washing, dewatering and drying of the synthetic rutile product.

The treatment to remove thorium and/or uranium and/or one or more of their radionuclide daughters may advantageously be effected after and/or during step 4 and may be carried out simultaneously with step 6 by means of an acid leach, preferably with hydrochloric acid and preferably at a concentration of at least 0.05M, for example 0.5M. As previously mentioned, an initial sulphuric acid leach may be followed by a hydrochloric acid leach. The conventional acid leach in the Becher process is about 0.5M, typically of $H_2SO_4$.

Alternatively, the treatment to remove thorium and/or uranium and/or one or more of their radionuclide daughters may be carried out by substituting step 4 above with an acid leach to remove the metallic iron and the radionuclides in one step. Again, HCl is preferred for this leach.

In another application, a mixture of the aforesaid reagents including one or more glass forming compounds, and perhaps one or more glass modifiers, are added to the ilmenite and heated at a temperature in the range 900 to 1200° C. before treatment by the process which includes the main steps of the Becher process as described above, and then a leach to remove thorium and/or uranium and/or one or more of their radionuclide daughters. Alternatively, the heated ilmenite with the added reagents may be leached to remove thorium and/or uranium and/or one or more of their radionuclide daughters before treatment by the Becher process.

Removal of thorium and/or uranium and/or one or more of their radionuclide daughters may also be carried out by treatment of the usual synthetic rutile (SR) product from the Becher process. In a particular application, a mixture of the aforesaid reagents including one or more glass forming compounds, and perhaps one or more glass modifiers, are added to the SR product and heated at 900 to 1200° C. before a leach to remove thorium and/or uranium and/or one or more of the radionuclide daughters.

The invention is further described and illustrated by the following non-limiting examples. In the examples the $Th_{XRF}$ value given is the $^{232}Th$ content of the material as determined by x-ray fluorescence spectrometry (XRF) while the $Th_{\gamma}$ value is a $^{232}Th$ value calculated from a γ-spectrometry measurement of the $^{228}Th$ in the sample assuming that the $^{232}Th$ and $^{228}Th$ are in secular equilibrium. When the two thorium isotopes are, in fact, in secular equilibrium then the $Th_{XRF}$ and $Th_{\gamma}$, values are similar. When the $Th_{XRF}$ value is substantially less than the $Th_{\gamma}$ value, as is observed in several of the examples given, this means that the parent $^{232}Th$ has been removed to a greater extent than the radionuclide daughters. When no Th γ value is given in the Examples, qualitative measurements indicated that the activity of the sample had been reduced to a similar extent as the measured $Th_{XRF}$ value.

The analytical data and activity values for the ilmenite and synthetic rutile examples in the following samples were as follows:

TABLE A

| | ILMENITE | | | | SYNTHETIC RUTILE | |
|---|---|---|---|---|---|---|
| SAMPLE | A | B | E | F | C | D |
| XRF Analysis | | | | | | |
| Th (ppm) | 375 | 357 | 240 | 118 | 421 | 306 |
| $TiO_2$ (%) | 59.25 | 61.92 | 62.28 | 61.59 | 89.78 | 91.26 |
| $Fe_2O_3$ (%) | 35.15 | 33.45 | 32.33 | 32.62 | 6.43 | 4.54 |
| $Mn_3O_4$ (%) | 1.36 | 1.31 | 1.31 | 1.12 | 1.72 | 1.09 |
| $SiO_2$ (%) | 1.22 | 0.98 | 0.55 | 0.79 | 1.32 | 1.46 |
| $Al_2O_3$ (%) | 0.61 | 0.70 | 1.36 | 1.14 | 1.15 | 1.19 |
| CaO (%) | 0.00 | 0.00 | 0.00 | 0.01 | 0.00 | 0.02 |
| $Cr_2O_3$ (%) | 0.19 | 0.17 | 0.04 | 0.08 | 0.07 | 0.09 |
| $ZrO_2$ (%) | 0.20 | 0.19 | 0.05 | 0.22 | 0.93 | 0.21 |
| γ-spectrometry | | | | | | |
| $^{228}Ra$ (Bq/g) | 1.43 | 1.35 | n.d. | n.d. | 1.6 | 1.27 |
| $^{228}Th$ (Bq/g) | 1.44 | 1.35 | n.d. | n.d. | 1.7 | 1.26 |
| Calc Th (ppm) | 355 | 332 | n.d. | n.d. | 395 | 310 |

n.d. = Not determined

EXAMPLE 1

The effect of a heating pre-treatment for the ilmenite on subsequent removal of thorium from the ilmenite by leaching is shown in this example.

Samples of Eneabba North ilmenite (SAMPLE A), with $Th_{XRF}$ and $Th_{\gamma}$ assay values of 375 and 355 ppm Th, respectively, were heated at 500, 750, 1000, 1100, 1200, 1300 and 1400° C. in a muffle furnace for 2 or 16 hours.

The heated ilmenite samples, and a sample of un-heated ilmenite, were reacted with 2 molar sodium hydroxide solution at a solids content of 40 wt. % solids in a reactor fitted with a stirrer rotating continuously at 750 rev/min., a thermopocket containing a thermometer (or thermocouple) and a reflux condenser. The reactor was heated by a heating mantle that was connected via a temperature controller to the thermocouple. In this way, the reaction mixture could be maintained at the desired temperature. The mixture was heated at 70° C. for 1 h. The solid residue was then filtered, thoroughly washed with water and analysed The sodium hydroxide treated product was then returned to the reactor and leached with 6 molar hydrochloric acid containing 0.5 molar sodium fluoride solution at a solids content of 25 wt. % solids at 85° C. for 2 h. The solid residue was again filtered, washed thoroughly with water, dried and analysed.

The thorium analyses for the un-heated and heated samples of SAMPLE A after the leaching with sodium hydroxide followed by hydrochloric acid containing sodium fluoride are given in Table 1.

TABLE 1

| HEATING TEMPERATURE (° C.) | HEATING TIME (h) | $Th_{XRF}$ (ppm Th) | $Th_{\gamma}$ (ppm Th) |
|---|---|---|---|
| * | * | 89 | 307 |
| 500 | 2 | 98 | 302 |
| 750 | 2 | 156 | 270 |
| 1000 | 2 | 294 | 270 |
| 1100 | 16 | 258 | 248 |
| 1200 | 16 | 157 | 150 |

TABLE 1-continued

| HEATING TEMPERATURE (° C.) | HEATING TIME (h) | $Th_{XRF}$ (ppm Th) | $Th_{\gamma}$ (ppm Th) |
|---|---|---|---|
| 1300 | 16 | 205 | 182 |
| 1400 | 16 | 90 | 98 |

* Unheated but otherwise treated sample of SAMPLE A. The $Th_{XRF}$ and $Th_{\gamma}$ values for SAMPLE A were 375 and 355 ppm Th respectively.

The results in Table 1 show that

1) Good leaching of $^{232}$Th, but virtually no $^{228}$Th, is achieved at temperatures of 500° C. and lower.
2) At intermediate temperatures of 750 and 1000° C., moderate leaching of $^{232}$Th is obtained with increasing amounts of $^{228}$Th also being leached, but the total removal of thorium is less than with the unheated sample.
3) At higher temperatures in the range 1000–1300° C., especially at or above 1200° C., moderate amounts of both $^{232}$Th and $^{228}$Th (i.e. parent $^{232}$Th and the radionuclide daughters) are equally removed, with the total thorium removal improving with increasing temperature.
4) At 1400° C. good total removal of thorium is achieved with both $^{232}$Th and $^{228}$Th being removed to a similar extent. The radioactivity of the resultant product was found to be substantially less than that of the unheated sample after leaching.

EXAMPLE 2

The effect of a heating pre-treatment before reduction and aeration of the ilmenite on subsequent removal of thorium from the resulting ilmenite by leaching is shown in this example.

Samples of Eneabba North ilmenite (SAMPLE A) were heated at 750, 1000, 1200, and 1400° C. in a muffle furnace for 2 or 16 hours. The heated samples were reduced with char (−2+0.5 mm) at 1100° C. under conditions established in the laboratory to give a product similar to that produced in the reduction kiln in the Becher process.

The reduced ilmenite produced was aerated in an ammonium chloride medium under conditions similar to those used in the Becher process to remove metallic iron and then leached with hydrochloric acid containing sodium fluoride at 25 wt. % solids at 90° C. for 2 hours. In some cases the acid leach was preceded with a leach with 2.5M NaOH at 25 wt. % solids at 75° C. for 1 hour.

In Table 2, the results for the heated and reduced samples are compared with that for a sample that was not heated before reduction. The results show that as the temperature of the heating pre-treatment increases, the amount of thorium removed in the acid leach also increases. The results also show that the activity is removed to the same extent as the thorium.

TABLE 2

| PRE-HEAT | | REDUCTION | | | | |
|---|---|---|---|---|---|---|
| Temp (° C.) | Time (h) | Temp (° C.) | Time (h) | ACID LEACH* | $Th_{XRF}$ (ppm) | $Th_{\gamma}$ (ppm) |
| — | — | 1100 | 1 | A | 305 | 295 |
| 750 | 2 | 1100 | 1 | A | 279 | n.d. |

TABLE 2-continued

| PRE-HEAT | | REDUCTION | | | | |
|---|---|---|---|---|---|---|
| Temp (° C.) | Time (h) | Temp (° C.) | Time (h) | ACID LEACH* | $Th_{XRF}$ (ppm) | $Th_{\gamma}$ (ppm) |
| 1000 | 2 | 1100 | 1 | B | 259 | 270 |
| 1200 | 16 | 1100 | 1 | B | 258 | 258 |
| 1400 | 16 | 1100 | 1.5 | B | 153 | n.d. |

*After aeration with $NH_4/Cl + O_2$ to remove metallic iron, reduced samples were leached with 6 M HCl + 0.1 M NaF(A), or 2.5 M NaOH then 6 M HCl + 0.5 M NaF (B).
n.d. = Not determined

EXAMPLE 3

The enhanced leachability of thorium and its daughters from synthetic rutile after heating the synthetic rutile is shown in this example.

Samples of standard grade synthetic rutile (SR) from the Narngulu plant (SAMPLE C) were heated in a muffle furnace at temperatures of 1000–1400° C. for 16 hours. The heated SR samples were then leached with sodium hydroxide at 25 wt. % solids at 75° C. for 1 hour, followed by hydrochloric acid containing sodium fluoride at 25 wt. % solids at 90° C. for 2 hours. The results in Table 3 show that the parent Th and the radionuclide daughters are removed to a greater extent from the SR samples as the temperature at which it is heated increases.

TABLE 3

| Heating Temperature (° C.) | Heating time (h) | $Th_{XRF}$ (ppm Th) | $Th_{\gamma}$ (ppm Th) |
|---|---|---|---|
| No heating | — | 421 | 395 |
| No heating but leached | | 302 | 300 |
| 1100 | 16 | 250 | 197 |
| 1200 | 16 | 223 | 221 |
| 1300 | 16 | 235 | 214 |
| 1400 | 16 | 170 | 160 |

EXAMPLE 4

The effect of the addition of silica alone, and with other reagents, to the ilmenite before a heat treatment is shown in this example.

Samples of Eneabba North ilmenite (SAMPLE A) were mixed with precipitated silica, and mixtures of precipitated silica and sodium fluoride or monosodium dihydrogen phosphate dihydrate, and heated in a muffle furnace at 1000 to 1300° C. for 1 to 2 hours. A sub-sample of the heated sample was leached with hydrochloric acid containing sodium fluoride at 25 wt. % solids at 90° C. for 2 hours.

In Table 4, the results for the treated, heated and leached ilmenite samples are compared with those for ilmenite heated and leached but without addition of silica or the other reagents. The results shown that the addition of silica alone has little effect after heating at 1150° C., but that the addition of sodium fluoride is beneficial with the thorium removal increasing with increasing heating temperature. The results show that the activity is removed to a similar extent as the thorium.

The addition of a phosphate with the silica results in better thorium removal and heating temperatures of only 1000° C. are required.

TABLE 4

| REAGENT | ADDITION Total (% W/W) | ADDITION Ratio | HEATING Temp (° C.) | HEATING Time (h) | ACID LEACH* | $Th_{XRF}$ (ppm) | $Th_{\gamma}$ (ppm) |
|---|---|---|---|---|---|---|---|
| No additive | — | — | 1000 | 2 | A | 294 | 270 |
| No additive | — | — | 1200 | 2 | A | 250 | n.d. |
| $SiO_2$ | 3 | — | 1150 | 1 | B | 299 | 283 |
| $SiO_2$ + NaF | 5 | 1:1 | 1000 | 1 | B | 228 | n.d. |
| $SiO_2$ + NaF | 5 | 1:1 | 1150 | 1 | B | 228 | 233 |
| $SiO_2$ + NaF | 5 | 1:1 | 1300 | 1 | B | 80 | 81 |
| $SiO_2$ + MSP | 3 | 1:1 | 1000 | 2 | B | 132 | n.d. |
| $SiO_2$ + MSP | 5 | 1:2 | 1000 | 2 | B | 45 | n.d. |
| Water glass | 4.7 | — | 1000 | 2 | C | 183 | n.d. |
| | 1.7 | — | 1000 | 1.5 | C | 125 | n.d. |

*Acid leach with 2.5M NaOH then 6M HCl + 0.5M NaF (A), or 6M HCl + 0.5M NaF (B), or 6M HCl + 0.2M NaF (C).
n.d. = not determined

EXAMPLE 5

The effect of the addition of a phosphate compound to the ilmenite before a heat treatment is shown in this example.

A sample of Eneabba North ilmenite (SAMPLE A) was mixed with analytical reagent grade (AnalaR) monosodium dihydrogen phosphate dihydrate or with commercial phosphate samples (1 to 5% by weight), wetted with water, mixed wet, dried in an oven at 120° C. and then heated in a muffle furnace at 1000° C. for 1 hour. A sub-sample of the phosphate-treated and heated ilmenite was leached with an acid containing sodium fluoride at 25 wt. % solids at 90° C. for two hours.

In Table 5, the results for the phosphate-treated, heated and leached ilmenite are compared with those for ilmenite that was heated and leached without addition of phosphate before heating. The results indicate that the thorium removal is much greater from the material treated with phosphate. The results also indicate that an increased acid strength is needed to achieve a similar degree of thorium removal for lower reagent addition.

TABLE 5

| REAGENT * | ADDITION (% W/W) | HEATING Temp (° C.) | HEATING Time (h) | ACID LEACH | $Th_{XRF}$ (ppm) | $Th_{\gamma}$ (ppm) |
|---|---|---|---|---|---|---|
| No additive | — | 1000 | 2 | A | 294 | 270 |
| AR Grade | | | | | | |
| MSP | 1 | 1000 | 1 | B | 164 | n.d. |
| MSP | 2 | 1000 | 1 | B | 97 | 100 |
| MSP | 2 | 1000 | 1 | C | 136 | 204 |
| MSP | 5 | 1000 | 1 | D | 67 | 81 |

TABLE 5-continued

| REAGENT * | ADDITION (% W/W) | HEATING Temp (° C.) | HEATING Time (h) | ACID LEACH | $Th_{XRF}$ (ppm) | $Th_{\gamma}$ (ppm) |
|---|---|---|---|---|---|---|
| Commercial Grade | | | | | | |
| MSP | 2 | 1000 | 1 | B | 55 | n.d. |
| SPP | 2 | 1000 | 1 | B | 55 | n.d. |
| TSPP | 2 | 1000 | 1 | B | 50 | n.d. |

* MSP = monosodium dihydrogen phosphate dihydrate
SPP = sodium pyrophosphate
TSSP = tetrasodium pyrophosphate
Acid leach with 2.5 M NaOH then 6 M HCl + 0.5 M NaF (A), or 6 M HCl + 0.1 M NaF (B), or 3 M $H_2SO_4$ + 0.1 M NaF (C) or 1 M HCl + 0.1 M NaF (D)
n.d. = Not determined

EXAMPLE 6

The effect of the addition of a fluoride salt alone, and with other reagents, to the ilmenite before a heat treatment is shown in this example.

Sodium or calcium fluoride, alone, or in combination with sodium carbonate, a phosphate, or borax were added to one of two Eneabba North ilmenites (SAMPLE A or SAMPLE B). The samples were heated in a muffle furnace at 1000 or 1150° C. for 1 hour and leached with hydrochloric acid or hydrochloric acid containing sodium fluoride at 25 wt. % solids at 90° C. for 2 hours.

The results in Table 6 indicate that the addition of sodium fluoride alone, or the fluorides in combination with the other reagents, resulted in a substantially greater removal of thorium in the heat and leach treatment compared with the samples to which no reagents were added before the heat and leach.

TABLE 6

| ILMENITE | REAGENT* | ADDITION Total (wt %) | ADDITION Ratio | HEATING Temp (° C.) | HEATING Time (h) | ACID LEACH | $Th_{XRF}$ (ppm) |
|---|---|---|---|---|---|---|---|
| A | No additive | — | — | 1000 | 2 | A | 294 |
| B | No additive | — | — | 1000 | 2 | B | 255 |
| A | NaF | 5 | — | 1000 | 1 | B | 76 |

TABLE 6-continued

| ILMENITE | REAGENT* | ADDITION Total (wt %) | ADDITION Ratio | HEATING Temp (° C.) | HEATING Time (h) | ACID LEACH | $Th_{XRF}$ (ppm) |
|---|---|---|---|---|---|---|---|
| A | $CaF_2$ | 5 | — | 1000 | 1 | B | 303 |
| A | NaF + $Na_2CO_3$ | 5 | 1:1 | 1000 | 1 | B | 65 |
| B | $CaF_2$ + $Na_2CO_3$ | 5 | 1:2 | 1150 | 1 | B | 141 |
| B | NaF + MSP | 5 | 1:9 | 1000 | 1 | C | 55 |
| B | $CaF_{2\ +\ TSPP}$ | 2 | 1:4 | 1000 | 1 | D | 136 |
| A | NaF + borax | 5 | 1:1 | 1000 | 1 | B | 110 |
| B | $CaF_2$ + borax | 5 | 1:1 | 1000 | 1 | D | 55 |

*MSP = monosodium dihydrogen phosphate dihydrate
TSSP = tetrasodium pyrophosphate
Acid leach with 2.5M NaOH then 6M HCl + 0.5M NaF (A), or 6M HCl + 0.5M NaF (B), or 6M HCl + 0.1M NaF (C), or 1M HCl (D)

EXAMPLE 7

The effect of the addition of borate minerals to the ilmenite before a heat treatment is shown in this example.

Naturally occurring borate minerals, in particular a sodium borate (borax $Na_2B_4O_70.10H_2O$), a sodium calcium borate (ulexite $NaCaB_5O_90.8H_2O$) and a calcium borate (colemanite $Ca_2B_6O_{11}0.5H_2O$) were added at 2 to 5% by weight to Eneabba North ilmenite (SAMPLE B), heated in a muffle face at 900 to 1100° C. and leached with hydrochloric acid or hydrochloric acid containing sodium fluoride at 25 wt. % solids at 60 or 90° C. for 2 hours.

In Table 7 the results for the ilmenite treated with a borate mineral, heated and leached are compared with that for a sample that was heated and leached without the addition of a borate. The results show that good removal of thorium was achieved with borax and ulexite after heating at 1000 and 1100° C. but that a heating temperature of 1100° C. is necessary when colemanite is added This is in line with the higher melting temperature of colemanite compared with borax and ulexite. The results also show that more thorium is removed when the amount of borate added is increased.

TABLE 7

| REAGENT | ADDITION (% W/W) | HEATING Temp (° C.) | HEATING Time (h) | ACID LEACH * | $Th_{XRF}$ (ppm) |
|---|---|---|---|---|---|
| No additive | — | 1000 | 2 | A | 255 |
| Borax | 3 | 1000 | 1 | B | 134 |
| | 4 | 1000 | 1 | C | 113 |
| Ulexite | 3 | 1000 | 1 | B | 187 |
| | 3 | 1100 | 1 | B | 78 |

TABLE 7-continued

| REAGENT | ADDITION (% W/W) | HEATING Temp (° C.) | HEATING Time (h) | ACID LEACH * | $Th_{XRF}$ (ppm) |
|---|---|---|---|---|---|
| | 4 | 1100 | 1 | B | 45 |
| Colemanite | 3 | 900 | 1 | B | 275 |
| | 3 | 1000 | 1 | B | 247 |
| | 3 | 1100 | 1 | B | 98 |
| | 2 | 1100 | 1 | B | 70 |
| | 3 | 1100 | 1 | B | 98 |
| | 5 | 1100 | 1 | B | 64 |

* Acid Leach with 6 M HCl + 0.5 M NaF (A), or 1 M HCl (B), or 1 M HCl + 0.1 M NaF (C)

EXAMPLE 8

In this example, the effect of the addition of a borate mineral (borax or ulexite) and a calcium salt (fluoride, hydroxide, or sulphate) to ilmenite before heating is shown.

A borate mineral and a calcium salt (3 to 4% by weight in the ratio 1:1 or 2:1) were added to Eneabba North ilmenite (SAMPLE B) and heated in a muffle furnace at 900 to 1100° C. for 1 hour and then leached with hydrochloric acid or hydrochloric acid containing sodium fluoride at 25 wt. % solids at 60 or 90° C. for 2 hours.

The results in Table 8 show that good removal of thorium and activity was achieved, particularly with heating temperatures of 1000 and 1100° C. The results also show that, when calcium fluoride is added, a large amount of thorium can be removed in an acid leach with a low acid strength of 0.25M HCl.

TABLE 8

| REAGENT | ADDITION Total (% W/W) | ADDITION Ratio | HEATING Temp (° C.) | HEATING Time (h) | ACID LEACH* | $Th_{XRF}$ (ppm) | $Th_{\gamma}$ (ppm) |
|---|---|---|---|---|---|---|---|
| No additive | — | — | 1000 | 2 | A | 255 | 253 |
| Borax + $CaF_2$ | 3 | 1:1 | 900 | 1 | B | 203 | 200 |
| | 3 | 1:1 | 1000 | 1 | B | 123 | 118 |
| | 3 | 1:1 | 1100 | 1 | B | 74 | 84 |
| Ulexite + $CaF_2$ | 3 | 1:1 | 1000 | 1 | B | 76 | 72 |
| Borax + $Ca(OH)_2$ | 3 | 2:1 | 1000 | 1 | C | 78 | n.d. |

TABLE 8-continued

| REAGENT | ADDITION Total (% W/W) | ADDITION Ratio | HEATING Temp (° C.) | HEATING Time (h) | ACID LEACH* | $Th_{XRF}$ (ppm) | $Th_{\gamma}$ (ppm) |
|---|---|---|---|---|---|---|---|
| Ulexite + $Ca(OH)_2$ | 3 | 2:1 | 1000 | 1 | C | 40 | n.d. |
| Borax + $CaSO_4 - 2H_2O$ | 4 | 1:1 | 1000 | 1 | C | 146 | n.d. |

*Acid leach with 6M HCl + 0.5M NaF (A), or 0.25M HCl (B), or 1M HCl (C)
n.d. = not determined

EXAMPLE 9

The removal of thorium and uranium from a sample of ilmenite treated with borax and calcium fluoride (fluorite) by leaching after a heat treatment is shown in this example.

Samples of Eneabba North ilmenite (SAMPLE B) wee mid with borax and calcium fluoride (2 to 5% by weight in a 1:1 or 2:1 ratio) and heated in a muffle furnace at 1000 or 1150° C. for 1 hour and then leached with hydrochloric acid or hydrochloric acid containing sodium fluoride at 25 wt. % solids at 60° C. for 2 hours.

The results in Table 9 show that the thorium (both the parent $^{232}Th$ as indicated by $Th_{XRF}$ value and daughter $^{228}Th$ as indicated by the $Th_{\gamma}$ value) and uranium in the ilmenite are removed by the heat and leach treatment. The results show that the amount of thorium and uranium removed increases with increasing addition of borax and calcium fluoride with a heating temperature of 1000° C. for 1 hour and a leach with 0.25M HCl. A higher heating temperature of 1150° C. and a leach with a stronger acid (2M HCl) results in removal of a larger amount of thorium and uranium.

TABLE 9

| REAGENT | ADDITION Total (% W/W) | ADDITION Ratio | HEATING Temp (° C.) | HEATING Time (h) | ACID LEACH* | $Th_{XRF}$ (ppm) | $Th_{\gamma}$ (ppm) | U (ppm) |
|---|---|---|---|---|---|---|---|---|
| No additive | — | — | — | — | — | 357 | 332 | 10.4 |
| No additive | — | — | 1150 | 1 | A | 190 | 172 | 11.0 |
| Borax + $CaF_2$ | 2 | 1 = 1 | 1000 | 1 | B | 164 | 140 | 8.3 |
| | 3 | 1 = 1 | 1000 | 1 | B | 123 | 118 | 7 3 |
| | 4 | 1 = 1 | 1000 | 1 | B | 75 | 74 | 6.2 |
| | 5 | 2 = 1 | 1000 | 1 | B | 92 | 91 | 5.9 |
| | 5 | 2 = 1 | 1150 | 1 | C | <25 | 25 | 2.2 |

*Acid leach with 6M HCl + 0.5M NaF (A), or 0.25M HCl (B), or 2M HCl (C)

EXAMPLE 10

The effect of the time ilmenite, treated with borax and calcium fluoride (fluorite), is heated at temperature is shown in this example.

Samples of Eneabba North ilmenite (SAMPLE B) were mixed with borax and calcium fluoride (3% by weight in a 1:1 ratio) and heated in a muffle furnace at 1000° C. for 0.25 to 4 hours and then leached with 0.25M hydrochloric acid at 25 wt. % solids at 60° C. for 2 hours.

The results in Table 10 suggest that there is an optimum time for which the sample should be heated in order to remove the greatest amount of thorium in the acid leach. The results also indicate that the activity is removed along with the thorium. Heating for too long reduces the amount of thorium removed.

TABLE 10

| REAGENT | ADDITION Total (% W/W) | ADDITION Ratio | HEATING Temp (° C.) | HEATING Time (h) | ACID LEACH* | $Th_{XRF}$ (ppm) | $Th_{\gamma}$ (ppm) |
|---|---|---|---|---|---|---|---|
| No additive | — | — | 1000 | 2 | A | 255 | 253 |
| Borax + $CaF_2$ | 3 | 1:1 | 1000 | 0.25 | B | 140 | 147 |
| | 3 | 1:1 | 1000 | 0.5 | B | 102 | 100 |
| | 3 | 1:1 | 1000 | 1 | B | 123 | 118 |
| | 3 | 1:1 | 1000 | 2 | B | 141 | 114 |
| | 3 | 1:1 | 1000 | 4 | B | 166 | 160 |

*Acid leach with 6M HCl + 0.5M NaF (A), or 0.25M HCl (B)

EXAMPLE 11

The effect of the addition of borate minerals to ilmenite before reduction is shown in this example.

Samples of Eneabba North ilmenite (SAMPLE A or SAMPLE B) were mixed with borate minerals (boa ulexite, or colemanite) or borate mineral (borax or ulexite) and calcium fluoride (fluorite), wetted with water, mixed wet, and added with char (−2+0.5 mm) to a silica pot. The sample was heated in a muffle furnace at 1000 or 1150° C. for 1 to 4 hours to reduce the ilmenite and form reduced ilmenite. A sub-sample of the reduced ilmenite was either aerated to remove metallic iron and leached with hydrochloric acid containing sodium fluoride at 25 wt. % solids at 60° C. for 2 hours or treated directly with hydrochloric acid at 9.1 wt. % solids at 60° C. for 2 hours to dissolve the metallic iron, thorium and associated activity.

In Table 11 results for the borate treated, reduced and leached samples are compared with those for samples reduced and leached but without the addition of the borate minerals. The results show that the addition of the borate minerals results in greater thorium removal. Also the results indicate that a higher reduction temperature gives higher thorium removal in the acid leach. The rutile is in a more reduced state in the product from reductions at 1150° C. than from reductions at 1100° C.

EXAMPLE 12

The effect of the addition of borate minerals to ilmenite before reduction with coal as a solid reductant and a heating profile similar to that existing in commercial Becher reduction kilns is shown in this example.

Samples of Eneabba North ilmenite (SAMPLE B) were mixed with borate minerals (borax, ulexite, or colemanite) or borax plus calcium fluoride (fluorite), mixed with coal (−10+5 mm) and placed in a drum. The drum was rolled inside a furnace and heated to a temperature of 1100 or 1150° C. using a heating profile similar to that in commercial Becher reduction kilns to obtain a reduced ilmenite sample of similar composition to that obtained in commercial plants. The reduced ilmenite was either aerated and leached with hydrochloric acid containing sodium fluoride at 25 wt. % solids at 60° C. for 2 hours or leached with hydrochloric acid directly at 9.1 wt. % solids at 60° C. for 2 hours.

The results in Table 12 indicate that good thorium removal is achieved with borax and calcium fluoride and with ulexite with a reduction temperature of 1150° C., while with colemanite this is achieved with a reduction temperature of 1100° C. The results indicate that the activity is removed along with the thorium.

TABLE 11

| ILMENITE | REAGENT | ADDITION Total (% W/W) | ADDITION Ratio | REDUCTION* Temp (° C.) | REDUCTION* Time (h) | ACID LEACH** | $Th_{XRF}$ (ppm) |
|---|---|---|---|---|---|---|---|
| A | No additive | — | — | 1100 | 1 | A | 305 |
| B | No additive | — | — | 1100 | 1 | A | 223 |
| A | Borax | 4 | — | 1100 | 1 | B | 114 |
| A | Borax | 4 | — | 1150 | 1 | C | 112 |
| A | Borax + $CaF_2$ | 5 | 3.5:1.5 | 1100 | 4 | D | 249 |
| A | Borax + $CaF_2$ | 5 | 3.5:1.5 | 1150 | 1.5 | D | 30 |
| B | Ulexite | 5 | — | 1100 | 1.5 | D | 99 |
| B | Ulexite | 5 | — | 1150 | 1.5 | D | <25 |
| B | Ulexite + $CaF_2$ | 5 | 2:1 | 1150 | 1.5 | D | 78 |
| B | Colemanite | 5 | — | 1100 | 1.5 | D | 53 |
| B | Colemanite | 5 | — | 1150 | 1.5 | D | 45 |

*Reduction in a silica pot with ilmenite:char (−2 + 0.5 mm) = 2:1

**Aeration and one (A) or two (B) acid leaches with 6M HCl + 0.5M NaF, or direct leach with 1.95M HCl and then 6M HCl + 0.5M NaF (C), or 2M HCl (D).

TABLE 12

| REAGENT | ADDITION Total (% W/W) | ADDITION Ratio | REDUCTION* Temp (° C.) | REDUCTION* Time (h) | ACID LEACH** | $Th_{XRF}$ (ppm) | $Th_{\gamma}$ (ppm) |
|---|---|---|---|---|---|---|---|
| No additive | — | — | 1100 | 10 | A | 256 | 246 |
| Borax | 4 | — | 1100 | 10 | A | 307 | 312 |
| Borax + $CaF_2$ | 5 | 2:1 | 1100 | 10 | B | 306 | n.d. |
| | 5 | 2:1 | 1150 | 10 | B | <25 | 25 |
| Ulexite | 5 | — | 1100 | 10 | B | 191 | n.d. |
| | 5 | — | 1150 | 5 | B | <25 | n.d. |
| Colemanite | 3 | — | 1100 | 11 | B | 89 | 96 |
| | | | | | C | 88 | 113 |
| | | | | | D | 88 | 103 |

*Reduction in a rotating drum with ilmenite:coal (−10 + 5 mm) = 1:1 with heating profile to the required temperature.
**Aeration and a leach with 6M HCl + 0.5M NaF (A), or a direct leach with 2M HCl (B) or 1.75M $H_2SO_4$ (C), or aeration and a leach with 2M HCl (D)
n.d. = Not determined

EXAMPLE 13

The selective removal of the thorium and then radium from ilmenite by an acid leach after reduction of the ilmenite is shown in this example.

A sample of Eneabba North ilmenite (SAMPLE B) mixed with colemanite (3% by weight) was reduced with coal (−10+5 mm) in a rotating drum at 1100° C. using a heating profile similar to that in commercial Becher ion kilns to obtain a reduced ilmenite sample of similar composition to that obtained in commercial plants. The reduced ilmenite was either leached with hydrochloric acid at 9.1 wt. % solids at 60° C. for 2 hours or aerated in ammonium chloride solution and then leached with sulphuric acid at 25 wt. % solids at 60° C. for 1 hour followed by hydrochloric acid at 25 wt. % solids at 60° C. for 1 hour.

The results in Table 13 show that leaching the reduced ilmenite with hydrochloric acid removes the thorium (both the parent $^{232}Th$ and daughter $^{228}Th$) and the radium (the daughter $^{228}Ra$). However, when sulphuric acid is used followed by hydrochloric acid, only the thorium is removed in the sulphuric acid leach and the radium is removed in the subsequent hydrochloric acid leach.

TABLE 13

| TREATMENT | $Th_{XRF}$ (ppm) | $Th_{\gamma}$ (ppm) | $^{228}Th$ (Bq/g) | $^{228}Ra$ (Bq/g) |
|---|---|---|---|---|
| Reduction to RI* | 399 | 344 | 1.40 | 1.39 |
| Leach of RI with 2 M HCl | 128 | 133 | 0.54 | 0.21 |
| Aeration of RI in $NH_4Cl$/air | 415 | 408 | 1.66 | 1.02 |
| Leach with 0.5 M $H_2SO_4$ | 145 | 165 | 0.67 | 1.00 |
| Further Leach with I M HCl | 128 | 123 | 0.50 | 0.15 |

*Reduction of SAMPLE B with colemanite (3% by weight) in a rotating drum with ilmenite:coal (−10 + 5 mm) = 1:1 with heating profile to 1100° C.

EXAMPLE 14

The removal of thorium and uranium from ilmenite treated with colemanite by leaching after its reduction to reduced ilmenite is shown in this sample.

A sample of Eneabba North ilmenite (SAMPLE B) mixed with colemanite (3% by weight) was reduced with coal (−10+5 mm) in a rotating drum at 1100° C. using a heating profile similar to that in commercial Becher reduction kilns to obtain a reduced ilmenite sample of similar composition to that obtained in commercial plants. The reduced ilmenite was either leached with hydrochloric acid at 9.1 wt. % solids at 60° C. for 2 hours or aerated in ammonium chloride solution and leached with hydrochloric acid at 9.1 wt. % solids at 60° C. for 2 hours.

The results in Table 14 show that both the thorium and uranium are removed in a hydrochloric leach of the reduced ilmenite either before or after aeration

TABLE 14

| TREATMENT | $Th_{XRF}$ (ppm) | $Th_{\gamma}$ (ppm) | U (ppm) |
|---|---|---|---|
| No treatment | 357 | 332 | 10.4 |
| Reduction* to RI with addition of ilmenite | 347 | 425 | 10.4 |
| Leach of RI with 2 M HCl | 89 | 96 | 6.3 |
| Aeration of RI with $NH_4Cl$/air | 458 | 442 | 13.5 |
| Leach of with 2 M HCl | 88 | 103 | 6.5 |

*Reduction of SAMPLE B plus colemanite (3% by weight) in rotating drum with ilmenite:coal (−10 + 5 mm) = 1:1 and 10 hours heating profile to 1100° C.

EXAMPLE 15

The effect of a heating pre-treatment before reduction on the removal of thorium in an acid leach is shown in this example.

Samples of Eneabba North ilmenite (SAMPLE B) were mixed with ulexite or colemanite (3% by weight) and heated at 1000 or 1100° C. for 1 hour. The heated sample was cooled and then reduced with coal (−10+5 mm) in a rotating drum at 1100° C. using a heating profile similar to that in commercial Becher reduction kilns to obtain a reduced ilmenite sample of similar composition to that obtained in commercial plants. The reduced ilmenite was leached with hydrochloric acid at 9.1 wt. % solids at 60° C. for 2 hours.

In Table 15 the results for ilmenite treated with ulexite or colemanite, heated, reduced and leached are compared with those for samples reduced, or heated and reduced, without the addition of the borate minerals. The results show that thorium is removed in the acid leach on the samples treated with ulexite or colemanite before heating.

TABLE 15

| REAGENT | ADDITION | PRE-HEAT Temp (° C.) | PRE-HEAT Time (h) | REDUCTION* Temp (° C.) | REDUCTION* Time (h) | ACID LEACH | $Th_{XRF}$ (ppm) |
|---|---|---|---|---|---|---|---|
| No additive | — | — | — | 1100 | 10 | 2M HCl | 350 |
| No additive | — | 1000 | 1 | 1100 | 10 | 2M HCl | 379 |
| Ulexite | 3 | 1000 | 1 | 1100 | 10 | 2M HCl | 172 |
| Ulexite | 3 | 1100 | 1 | 1100 | 10 | 2M HCl | 187 |
| Colemanite | 3 | 1000 | 1 | 1100 | 10 | 2M HCl | 134 |
| Colemanite | 3 | 1100 | 1 | 1100 | 10 | 2N HCl | 177 |

*Reduction in rotating drum with heated ilmenite:coal (−10 + 5 mm) = 1:1 and 10 hours heating profile to 1100° C.

EXAMPLE 16

The effect of the addition of borate minerals to ilmenite before reduction in an atmosphere of hydrogen and carbon dioxide is shown in this example.

Samples of Eneabba North ilmenite (SAMPLE A) were mixed with borate minerals (borax, ulexite, or colemanite), placed in a molybdenum boat and positioned inside a glass tube in the hot zone of a tube furnace. The sample was reduced at 1100 or 1150° C. for 2 or 4 hours in a flowing gas stream of a mixture of hydrogen and carbon monoxide of composition such as to give a similar oxygen partial pressure as in a Becher reduction kiln ($PH_2/PCO_2$=34.68). The resulting reduced ilmenite was leached with hydrochloric acid at 9.1 wt. % solids at 60° C. for 2 hours.

The results in Table 16 show that good thorium removal was achieved in the acid leach in all cases.

TABLE 16

| REAGENT | ADDITION (% W/W) | REDUCTION* Temp (° C.) | REDUCTION* Time (h) | ACID LEACH ** | $Th_{XRF}$ (ppm) |
|---|---|---|---|---|---|
| No additive | — | 1100 | 2 | A | 419 |
| Borax | 4 | 1150 | 2 | A | 40 |
| | 5 | 1150 | 4 | A | 32 |

TABLE 16-continued

| REAGENT | ADDITION (% W/W) | REDUCTION* Temp (° C.) | REDUCTION* Time (h) | ACID LEACH ** | $Th_{XRF}$ (ppm) |
|---|---|---|---|---|---|
| Ulexite | 5 | 1100 | 2 | A | 91 |
| | | 1150 | 2 | A | <25 |
| Colemanite | 5 | 1100 | 2 | A | 82 |
| | 2 | 1150 | 2 | A | <25 |

* Reduction in molybdenum boat in flowing $H_2 + CO_2$ gas mixture with $PH_2/PCO_2$ – 34.68 equivalent to reduction potential in a commercial Becher kiln.
** Acid leach with 2 M HCl (A)

EXAMPLE 17

Removal of thorium from plant synthetic rutile after treatment with a borate mineral, heating, and leaching is shown in this example.

Samples of synthetic rutile from the plant at Narngulu (SAMPLE C) we mixed with borax, borax and calcium fluoride (fluorite), ulexite or colemanite and heated at 1000 or 1150° C. for 1 hour and then leached with hydrochloric acid at 25 wt. % solids at 60 or 90° C. for 2 hours.

In Table 17 results for plant synthetic rutile treated with borates, heated and leached are compared with those for the synthetic rutile either just leached or heated and leached without the addition of borate minerals. The results show that thorium is removed from the synthetic rutile by an acid leach when the borate minerals are added.

TABLE 17

| REAGENT | ADDITION Total (% W/W) | ADDITION Ratio | HEATING Temp (° C.) | HEATING Time (h) | ACID LEACH* | $Th_{XRF}$ (ppm) | $Th_{\gamma}$ (ppm) |
|---|---|---|---|---|---|---|---|
| No additive | — | — | — | — | — | 421 | 395 |
| No additive | — | — | — | — | A | 302 | 300 |
| No additive | — | — | 1000 | 2 | A | 260 | n.d. |
| Borax | 5 | — | 1150 | 1 | B | 103 | n.d. |
| Borax + $CaF_2$ | 3 | 1:1 | 1000 | 1 | C | 187 | n.d. |
| Ulexite | 5 | — | 1100 | 1 | C | 89 | n.d. |
| Ulexite | 5 | — | 1150 | 1 | c | <25 | n.d. |
| Colemanite | 5 | — | 1100 | 1 | C | 71 | n.d. |
| Colemanite | 5 | — | 1150 | 1 | C | <25 | 23 |

*Leach with 2.5M NaOH followed by 6M HCl + 0.5M NaF (A), or 6M HCl (B), or 2M HCl (C).
n.d. = Not determined

EXAMPLE 18

In this example the selective removal of thorium and then radium from plant synthetic rutile by an acid leach after heating is shown.

A sample of synthetic rutile from the plant at Narngulu (SAMPLE D) was mixed with ulexite (2% by weight) and heated at 1100° C. for 1 hour. Sub-samples of the heated material were leached with hydrochloric acid at 25 wt. % solids at 60° C. for 1 hour or with sulphuric acid followed by hydrochloric acid at 25 wt. % solids at 60° C. for 1 hour.

The results in Table 18 show that both the thorium and radium are removed when the heated material is leached with hydrochloric acid only but when sulphuric acid is used first and then hydrochloric acid, the thorium (parent $^{232}$Th and daughter $^{228}$Th) is removed in the first leach and the radium ($^{228}$Ra) is removed in the second leach.

TABLE 18

| | HEATING | | | | | | | |
|---|---|---|---|---|---|---|---|---|
| REAGENT | ADDITION (% W/W) | Temp (° C.) | Time (h) | ACID LEACH | $Th_{XRF}$ (ppm) | $Th_{\gamma}$ (ppm) | $^{228}Th$ (Bq/g) | $^{228}Ra$ (Bq/g) |
| No additive | — | 1100 | 1 | 1M HCl | 276 | n.d. | n.d. | n.d. |
| Ulexite | 3 | 1100 | 1 | — | 290 | 338 | 1.38 | 1.28 |
| Ulexite | 2 | 1100 | 1 | 1M HCl | 109 | 120 | 0.49 | 0.18 |
| Ulexite | 2 | 1100 | 1 | 0.5M $H_2SO_4$ | 99 | 125 | 0.51 | 1.38 |
| | | | | 1M HCl | 99 | 91 | 0.37 | 0.26 |

n.d. = Not determined

EXAMPLE 19

The removal of thorium from different ilmenite samples from Western Australia is shown in this example.

A sample of ilmenite from different deposits in Western Australia (SAMPLES E and F) was mixed with colemanite (5% by weight) and reduced with coal (−10+5 mm) in a rotating drum at 1100° C. using a heating profile similar to that in commercial Becher reduction kilns to obtain a reduced ilmenite sample of similar composition to that obtained in commercial plants. The reduced ilmenite was leached with hydrochloric acid at 9.1 wt. % solids at 60° C. for 2 hours to remove thorium.

In Table 19 the results for the two samples, with and without the addition of colemanite, are compared with the corresponding values for an Eneabba North ilmenite (SAMPLE B). The results show that the thorium can be removed from other ilmenites as well as from Eneabba North ilmenite.

TABLE 19

| | REAGENT | REDUCTION* | | ACID | |
|---|---|---|---|---|---|
| ILMENITE | ADDITION (% w.w.) | Temp (° C.) | Time (h) | LEACH ** | $Th_{XRF}$ (ppm) |
| B | 0 | 1100 | 10 | A | 379 |
| B | 5 | 1100 | 10 | A | 47 |

TABLE 19-continued

| | REAGENT | REDUCTION* | | ACID | |
|---|---|---|---|---|---|
| ILMENITE | ADDITION (% w.w.) | Temp (° C.) | Time (h) | LEACH ** | $Th_{XRF}$ (ppm) |
| E | 0 | 1100 | 10 | A | 240 |
| E | 5 | 1100 | 10 | A | 96 |
| F | 0 | 1100 | 10 | A | 118 |
| F | 5 | 1100 | 10 | A | 74 |

*Reduction of ilmenite in rotating drum with ilmenite:coal (−10 + 5 mm) = 1:1 and 10 h heating profile to 1100° C.

** Acid leach with 2 M HCl

EXAMPLE 20

The removal of radium during the oxidation (aeration) of reduced ilmenite formed from ilmenite treated with colemanite is shown in this example.

A sample of Eneabba North ilmenite (SAMPLE B) was mixed with colemanite and reduced with coal (−10+5 mm) in a rotating drum at 1100° C. using a heating profile similar to that in commercial Becher reduction kilns to obtain reduced ilmenite. The reduced ilmenite was oxidised (aerated) to remove metallic iron in an ammonium chloride solution (1.2% w/w) at 80° C. with air bubbling through the suspension (to saturate it with oxygen) for 16 hours.

In Table 20 the results for two oxidised reduced ilmenite samples treated with colemanite are compared with the results for a sample without colemanite, and with the initial ilmenite sample. It can be seen that the thorium and radium levels in the product are higher in the untreated sample compared with the initial ilmenite due to removal of iron in the reduction and oxidation treatments. Also it can be seen that in the product from the ilmenite to which colemanite was added, the thorium has been concentrated to a similar degree as in the sample without colemanite but that an appreciable amount of the radium has been removed.

TABLE 20

| REAGENT | ADDITION (% W/W) | REDUCTION* Temp (° C.) | REDUCTION* Time (h) | OXIDATION** | PRODUCT $Th_{XRF}$ (ppm) | PRODUCT $Th_{\gamma}$ (ppm) | PRODUCT $228_{Th}$ (Bq/g) | PRODUCT $228_{Ra}$ (Bq/g) |
|---|---|---|---|---|---|---|---|---|
| No additive | — | — | — | — | 357 | 332 | 1.35 | 1.35 |
| No additive | — | 1100 | 10 | $NH_4$ Cl/air | 406 | 437 | 1.78 | 1.60 |
| Colemanite | 3 | 1100 | 10 | $NH_4$ Cl/air | 415 | 408 | 1.66 | 1.02 |
| Colemanite | 5 | 1100 | 10 | $NH_4$ Cl/air | 413 | 423 | 1.72 | 0.89 |

*Reduction in rotating drum with ilmenite:coal (−10 + 5 mm) - 1:1 with 10 hour heating profile to 1100° C.

**Oxidation (aeration) in 1.2% (W/V) $NH_4$ Cl solution at 80° C. for 16 hours, with air bubbling through the suspension

EXAMPLE 21

The effect of the addition of borate minerals to ilmenite before reduction on the removal of impurities such as silicon/silica, aluminium/alumina, manganese, and residual iron in the acid leach is shown in this example.

Samples of Eneabba North ilmenite (SAMPLE B) were mixed with borate minerals (borax, ulexite, or colemanite) or borax plus calcium fluoride (fluorite), mixed with coal (−10+5 mm) and placed in a drum. The drum was rolled inside a furnace and heated to a temperature of 1100 using a heating profile similar to that in commercial Becher reduction kilns to obtain a reduced ilmenite sample of similar composition to that obtained in commercial plants. The reduced ilmenite was leached with hydrochloric acid at 9.1 wt. % solids at 60° C. for 2 hours.

The results in Table 21 show that good removal of impurities is achieved, with a corresponding increase in $TiO_2$ content, when borate minerals are added to ilmenite before reduction.

TABLE 21

| REAGENT | ADDITION Total (% W/W) | ADDITION Ratio | REDUCTION Temp (° C.) | REDUCTION Time (h) | ACID LEACH | ASSAY VALUES $TiO_2$ (%) | ASSAY VALUES $Fe_2O_3$ (%) | ASSAY VALUES $Mn_3O_4$ (%) | ASSAY VALUES $SiO_2$ (%) | ASSAY VALUES $Al_2O_3$ (%) |
|---|---|---|---|---|---|---|---|---|---|---|
| No additive | — | — | 1100 | 10 | 2M HCl | 92.4 | 3.22 | 1.55 | 1.55 | 1.12 |
| Borax | 4 | — | 1100 | 10 | 2M HCl | 95.5 | 1.36 | 1.26 | 1.12 | 0.41 |
| Borax + $CaF_2$ | 5 | 2:1 | 1100 | 10 | 2M HCl | 93.1 | 2.24 | 1.04 | 1.65 | 0.35 |
| Ulexite | 5 | — | 1100 | 10 | 2M HCl | 95.7 | 1.47 | 0.90 | 1.42 | 0.61 |
| Colemanite | 3 | — | 1100 | 11 | 2M HCl | 93.8 | 2.72 | 1.24 | 1.27 | 0.51 |
| Colemanite | 5 | — | 1100 | 11 | 2M HCl | 95.8 | 2.91 | 0.92 | 0.58 | 0.42 |

We claim:

1. A process for treating iron-containing titanferous material by reducing iron in the titaniferous material largely to metallic iron in a reducing atmosphere in a kiln, thereby producing a so-called reduced titaniferous material, comprising feeding the titaniferous material, a reductant, and one or more reagents selected to enhance the accessibility of at least one of the radionuclide daughters in the titaniferous material, to the kiln, maintaining an elevated temperature in the kiln, the reagent(s) being selected to form a phase at said elevated temperature which disperses onto the surfaces of the titaniferous material and incorporates the radionuclides and said one or more radionuclide daughters, recovering a mixture which includes the reduced titaniferous material and said phase from the kiln at a discharge port, and treating the mixture to remove thorium and/or uranium and/or one or more of the radionuclide daughter.

2. A process according to claim 1, wherein said elevated temperature is in the range 900 to 1200° C.

3. A process according to claim 1, wherein said temperature is in the range 1050 to 1200° C.

4. A process according to claim 1, further including aqueous oxidation of the metallic iron to form a separable iron oxide, wherein the radionuclides are separated out during the oxidation.

5. A process according to claim 1, further including subjecting the treated titaniferous material to an acid leach to remove the radionuclides.

6. A process according to claim 5, wherein the acid is hydrochloric or sulphuric acid.

7. A process according to claim 5, wherein the leach comprises a primary leach with sulphuric acid and then a second leach with hydrochloric acid.

8. A process for facilitating the removal of radionuclides from titaniferous material which comprises the step of heating the titaniferous material to an extent effective to enhance the accessibility of at least one of the radionuclide daughters to subsequent removal.

9. A process according to claim 1, wherein said titaniferous material is heated to a temperature in excess of 500° C.

10. A process according to claim 9, wherein said temperature is at least 1000° C.

11. A process according to claim 8, wherein said temperature is at least 1300° C.

12. A process according to claim 1, wherein the heated titaniferous material is converted to synthetic rutile, which is subsequently leached to remove radionuclides.

13. A process according to claim 12, wherein said titaniferous material is ilmenite and said conversion includes reduction of iron therein to metallic iron and then aqueous oxidation of the metallic iron to form a separable iron oxide.

14. A process according to claim 8, wherein said titaniferous material is synthetic rutile formed by treatment of ilmenite, which treatment includes reduction of iron therein to metallic iron and then aqueous oxidation of the metallic iron to form a separable iron oxide.

15. A process for facilitating the removal of radionuclides and/or one or more of their radionuclide daughters from titaniferous material which comprises the step of treating the titaniferous material to cause aggregation or concentration of the radionuclides and one or more of their radionuclide daughters to an extent effective to enhance the accessibility of at least one of the radionuclide daughters to subsequent removal.

16. A process according to claim 14, wherein said treatment includes a heat treatment.

17. A process according to claim 16, wherein said treatment further includes the contacting of the titaniferous material with one or more reagents selected to form a phase as a result of said heat treatment which disperses onto the surfaces of the titaniferous material and incorporates the radionuclides and said one or more radionuclide daughters.

18. A process according to claim 17, wherein said reagent (s) include one or more glass forming reagents selected from the group of glass forming reagents including borates, fluorides, phosphates, and silicates.

19. A process according to claim 18, wherein said glass forming reagent(s) is selected from the group consisting of alkali and alkaline earth borates.

20. A process according to claim 18, wherein said glass forming reagent(s) is selected from the group consisting of calcium and sodium borates and calcium sodium borates.

21. A process according to claim 20, wherein said glass forming reagent(s) comprise one or more of $Ca_2B_8O_{11}$, $NaCaB_6O_9$ and $Na_2B_4O_7$.

22. A process according to claim 21, wherein said glass forming reagent(s) comprise one or more of colemanite, ulexite and borax.

23. A process according to claim 17, wherein said reagent (s) include one or more glass modifiers.

24. A process according to claim 23, wherein the glass modifier is fluorite.

25. A process according to claim 16, wherein said heat treatment comprises heating the titaniferous material to a temperature in the range 900 to 1200° C.

26. A process according to claim 25, wherein said temperature is in the range 1050 to 1200° C.

27. A process according to claim 17, wherein said titaniferous material is selected from the group including ilmenite, altered ilmenite, reduced ilmenite or synthetic rutile.

28. A process according to claim 17, wherein the radionuclide daughter(s) whose accessibility is enhanced include $^{228}Th$ and $^{228}Ra$.

29. A process according to claim 17, further including the step of separating radionuclide(s) from the titaniferous material.

30. A process according to claim 17, further including subjecting the treated titaniferous material to an acid leach to remove the radionuclides.

31. A process according to claim 30, wherein the acid is hydrochloric or sulphuric acid.

32. A process according to claim 30, wherein the leach comprises a primary leach with sulphuric acid and then a second leach with hydrochloric acid to remove radium.

33. A process according to claim 30, wherein the acid leach is carried out with added fluoride.

34. A process according to claim 1, wherein said iron-containing titaniferous material is ilmenite.

* * * * *

UNITED STATES PATENT AND TRADEMARK OFFICE

CERTIFICATE OF CORRECTION

PATENT NO. : 5,910,621

DATED : June 8, 1999

INVENTOR(S) : Harold Robert Harris, et al.

It is certified that error appears in the above-identified patent and that said Letters Patent is hereby corrected as shown below:

On the title page: Item [56]

Related U.S. Application Data [62]: delete "division" and insert --continuation--.

ABSTRACT [57]: in line 11, "daughter" should be --daughters--.

Col. 8, line 45: insert "." after --analysed--.

Col. 8, line 45: begin a new paragraph with "The sodium".

Col. 11, line 14: in Table 4: "1000" (last entry in column) should be --1100--.

Col. 13, line 24: "$Na_2B_4O_70.10H_2O$" should be --$Na_2B_4O_7.1OH_2O$--.

Col. 13, line 28: "face" should be --furnace--.

Col. 13, line 38: insert "." after --added--.

Col. 15: In Table 8: "Borax + $CaSO_4$-$2H_2O$" should be Borax +$CaSP_4$--.

Col. 15, line 18: "wee" should be --were--.

Col. 15: In Table 9: Under "Ratio" column, change all occurrences of "=" to --:--

Col. 17, line 21: "boa" should be --borax--.

Col. 19, line 29: "ion" should be --reduction--.

UNITED STATES PATENT AND TRADEMARK OFFICE

CERTIFICATE OF CORRECTION

PATENT NO. : 5,910,621

DATED : June 8, 1999

INVENTOR(S) : Harold Robert Harris, et al.

It is certified that error appears in the above-identified patent and that said Letters Patent is hereby corrected as shown below:

Col. 22, line 36: "we" should be --were--.

Col. 22: In Table 17: in ACID LEACH* column, "c" should be --C--.

Col. 25, line 63 (Claim 1): "daughter" should be --daughters--.

Col. 27, line 4 (Claim 16): "claim 14" should be --claim 15--.

Col. 27, line 22 (Claim 21): "$_8$" should be --$_6$--.

Col. 27, line 23 (Claim 21): "$_6$" should be --$_5$--.

Signed and Sealed this

Seventh Day of December, 1999

*Attest:*

*Attesting Officer*

Q. TODD DICKINSON

*Acting Commissioner of Patents and Trademarks*